United States Patent [19]

Resch

[11] 4,035,896

[45] July 19, 1977

[54] DEVICE FOR CRIMPING CONDUCTORS ONTO CONTACTS OF A CONTACT STRIP

[75] Inventor: Alois Ruppert Resch, Heilbronn, Germany

[73] Assignee: Bunker Ramo Corporation, Oak Brooks, Ill.

[21] Appl. No.: 677,509

[22] Filed: Apr. 15, 1976

[30] Foreign Application Priority Data

Apr. 15, 1975 Germany ..... 2516399

[51] Int. Cl.[2] ..... H01R 43/04

[52] U.S. Cl. ..... 29/753; 72/441; 72/444

[58] Field of Search ..... 29/203 DT, 203 DS, 203 D, 29/628, 203 P; 72/441, 444

[56] References Cited

U.S. PATENT DOCUMENTS 3,004,581 10/1961 Krol et al. ..... 29/203 DT

*Primary Examiner*—Carl E. Hall

*Attorney, Agent, or Firm*—William Lohff; F. M. Arbuckle

[57] ABSTRACT

A device for crimping conductors into the contact members of a contact strip. According to the invention there is provided a motor driven means for two crimping jaws movable relative to each other, and feeding means for stepwise advancing the contact strip in increments corresponding to the distance between the contacts to feed one contact to the crimping jaws in each operational cycle. An actuating device, which can be controllably manipulated by the operator, actuates the feeding means advancing the contact strip and, in a second position, effects the crimping operation and the return of the feeding means to the initial position.

7 Claims, 2 Drawing Figures

DEVICE FOR CRIMPING CONDUCTORS ONTO CONTACTS OF A CONTACT STRIP

BACKGROUND OF THE INVENTION

1. Field of the Invention

This invention relates to a device for crimping conductors into the contact members of a contact strip, of the type comprising motor driven means for reciprocating two crimping jaws movable relative to each other, and a feeding means for stepwise advancing the contact strip in increments corresponding to the distance between the contacts in order to feed one contact to the crimping jaws in each operational cycle.

2. Description of the Prior Art

Known devices of this type are designed so that one full operational cycle follows another in a predetermined constant sequence, the cycle comprising:

1. actuating the feeding means for the purposes of inserting the contacts to be crimped between the jaws of the crimping device;

2. executing the crimping operation once the operator has inserted the conductor to be crimped into the terminal section of the contact; and 3. returning the feeding means to its initial position.

One problem encountered with this design is that the time available to the operator for inserting the conductor into the terminal section of the contact member is fixed by the design details of the device and is usually very short. When a large number of conductors is to be crimped one after the other, the operator usually needs substantially more time for inserting the first conductor than for subsequent inserting operations.

If the time allowed to the operator for inserting the conductor is set to the maximum time required, the device is not operated efficiently, especially long after start-up when the operator no longer needs the long time which he initially required for the insertion operation. However, if the insertion time is reduced, an inexperienced operator usually has trouble in his training period as well as does an experienced operator at the beginning of each work period.

Furthermore, in known devices, the feeding means must be carefully adjusted before the device is put to use, because the motion of the device cannot be stopped once a working cycle has been initiated. When the feedling means has not been properly adjusted, there is the risk of damage to the crimping device.

SUMMARY OF THE INVENTION

The goal of the present invention is to create a device of the above-specified kind which is free of the shortcomings outlined above.

According to the invention, the goal is achieved by the provision of an actuating device, which can be controllably manipulated by the operator. The actuating device can be transferred from a rest position in which the motor driven means is disconnected, to a first operational position and, after passing through the first position, to a second operational position. In the first operational position, only the feeding means advancing the contact strip is actuated. In the second position, both the crimping operation and the return of the feeding means to the initial position are effected.

BRIEF DESCRIPTION OF THE DRAWINGS

The invention will now be explained in detail with reference to the preferred embodiment shown in the drawings. In the drawings.

DETAILED DESCRIPTION OF THE PREFERRED EMBODIMENT

Figure 1:
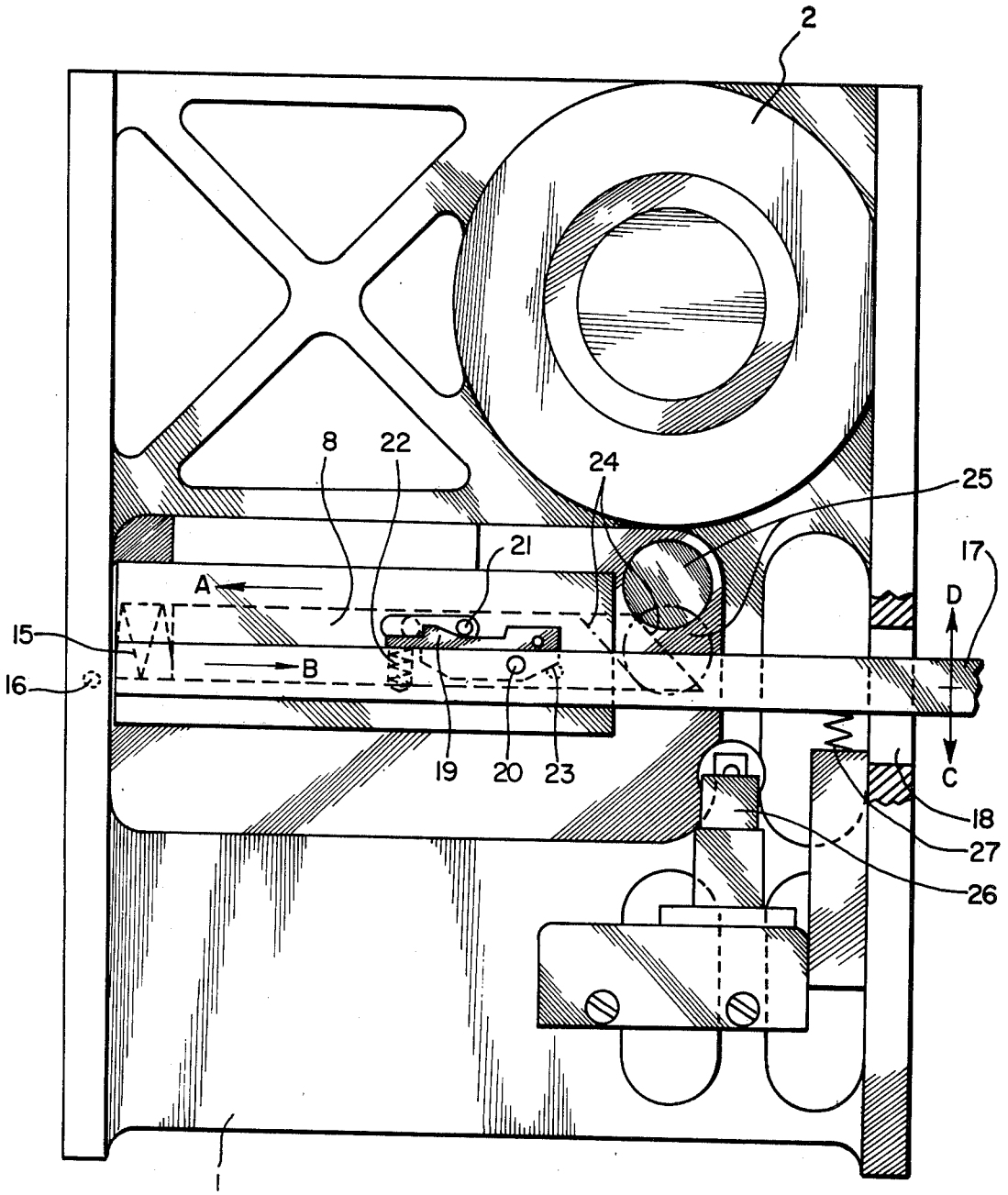
FIG. 1 is a schematic view of the rear side of the device of the invention.

The device comprises a housing 1 in which an electric motor 2, a crimping means 3, 4, 5 driven by the motor 2, and a feeding means 3, 9, 10 is mounted. The crimping means consist of two crimping jaws 3 and 4 one of which, jaw 3, is stationary and fixedly mounted to a portion of housing 1, while the other one, jaw 4, is attached to a ram 5 reciprocable in the vertical direction. The design of the crimping means is a matter of the prior art and need not be described in detail.

A guide rail 6 of U-shaped cross section, into which a contact strip 7 can be inserted, terminates adjacent the stationary crimping jaw 3.

Strips of contacts are also a matter of the prior art. The contact strips consist of individual contacts joined to a common continuous metal strip. The individual contacts may have a blade contact portion or jack contact portion joined with an adjacent terminal portion for crimping about a conductor. At the ends away from the contact portion, the terminal portions are joined by means of the common supporting strip.

Figure 2:
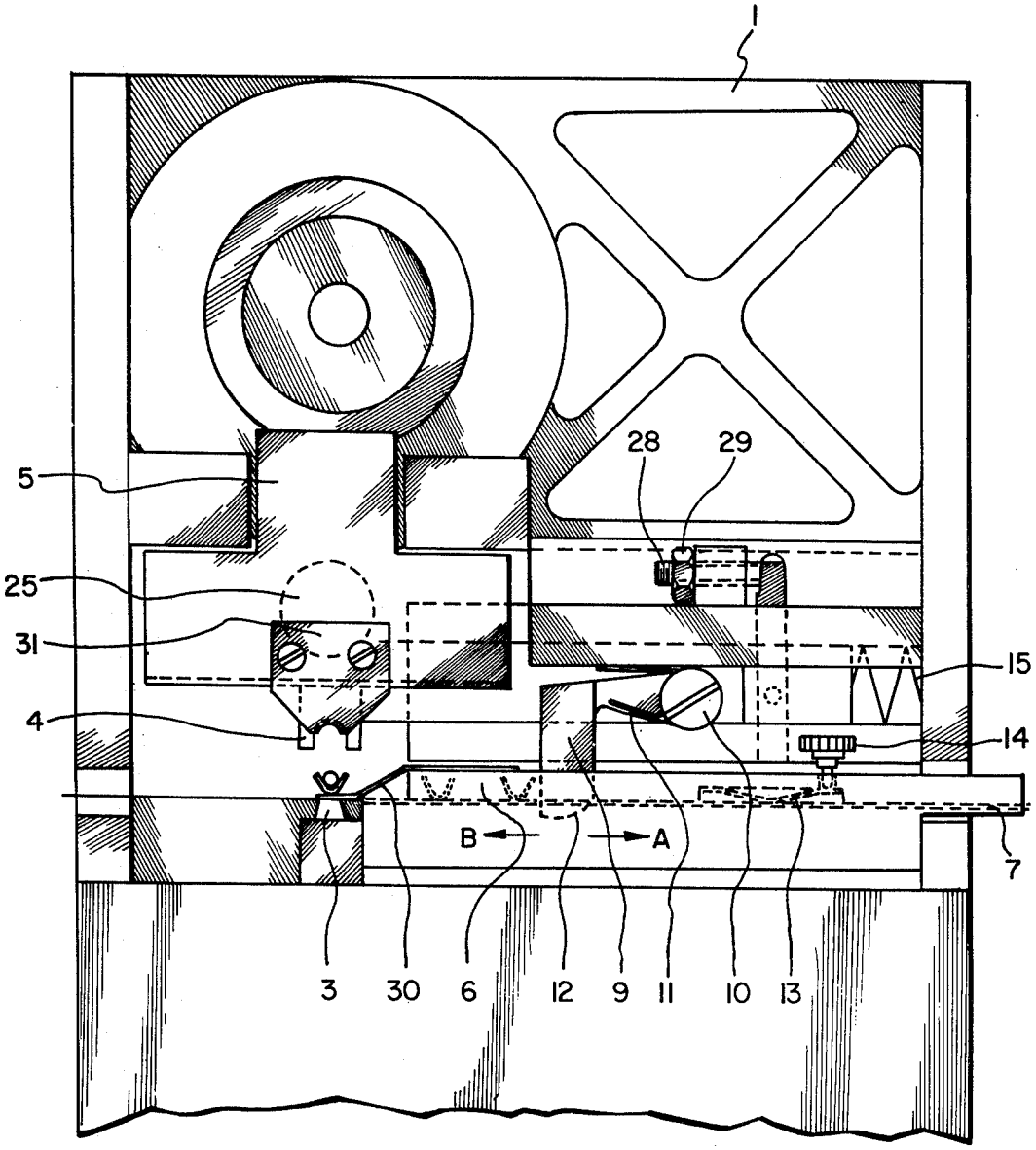
FIG. 2 is a schematic view of the front side of the device shown in FIG. 1.

The feeding means comprises a sliding member 8 movable in horizontal direction and an advancing lever 9 pivotally bearing onto the sliding member via a screw 10. As shown in FIG. 2, advancing lever 9 is biased toward contact strip 7 by means of a spring 11 and can assume a locked-in position between two adjacent contacts on the strip 7. One edge of advancing lever 9 is beveled so that when strip 7 is moved in the direction of arrow B, the advancing lever 9 will be lifted in vertical direction by the following contact. The advancing lever 9 therefore slides over the contact and snaps into a locked-in position behind that contact.

In guide rail 6 there is provided a leaf spring 13 which is pressed by a compression screw 14 onto contact strip 7, so that a frictional force is generated. The frictional force prevents the contact strip 7 from being dislodged by the above-described motion of the advancing lever 9. As shown in FIG. 1, sliding member 8 is spring biased in the direction B by means of a compression spring 15.

At a point denoted by reference number 16 in FIG. 1, there is pivotally mounted a lever 17 extending over the entire width of the housing and protruding through an opening 18 from the housing. Lever 17 is arranged adjacent sliding member 8. A stop pawl 19 is mounted on lever 17 and can rotate around a shaft 20. Just above stop pawl 19, a pin 21 is mounted on sliding member 8 so that the pin 21 can engage stop pawl. 19. At the end far from the pivot formed by shaft 20, the stop pawl 19 is biased toward pin 21 by means of a compression spring 22. Motion of the stop pawl 19 is limited by a stop 23 of appropriate shape.

The end of sliding member 8 far from compression spring 15 is provided with an inclined surface 24 against which a roller 25, reciprocable in the vertical direction, bears. Roller 25 is driven via control means by motor 2 which also actuates the crimping device 3, 4, 5 and the feeding means 8, 9, 10. The control means is not shown in detail but may comprise cam control means actuating the components in the proper timing sequence.

A switch 26 which can be actuated by lever 17 is mounted on housing 1 beneath lever 17. Switch 26 is connected to motor 2 and energizes the same for performing a full operational cycle. The corresponding circuit is not shown, because these circuits are a matter of the prior art. It is noted only that a short actuation of switch 26 suffices for keeping the motor energized for a full operational cycle. This is achieved by providing the motor with cam control means actuating a second switch which shunts switch 26, is closed upon a short depression of switch 26, and remains closed until the operational cycle has been completed.

Lever 17 is shown in its rest position in FIG. 1. In this position lever 17 is biased by a compression spring 27. The device is inactive in the rest position, and sliding member 8 is in a position locked with lever 17 by means of stop pawl 19.

The following is a description of the operation of the device. In the rest position (as shown in FIG. 1), there is no contact inserted between the crimping jaws 3 and 4. When lever 17 is depressed in the direction of arrow C into the first operational position, sliding member 8 snaps from stop pawl 19 and is transferred by compression spring 15 from the retracted position (indicated by dashed lines) to the position of engagement (solid lines). In this part of the operational cycle, (position of engagement) roller 25 is in the upper position (solid line).

By the shifting of sliding member 8 to the unlatched position in the direction of arrow B, advancing lever 9 of FIG. 2 moves to the left and shifts the contact strip over a distance equal to the contact spacing so that the next contact to be crimped is placed between jaws 3 and 4. In this first operational position of lever 17, the operator can insert the conductor to be crimped into the terminal portion of the contact.

Once this operation has been completed, the operator can transfer lever 17 from the first operational position to the second operational position in the direction of arrow C. In the second operational position, switch 26 is closed. As has been indicated above, motor 2 is then energized and causes downward motion of ram 5 to effect the crimping operation. At this time, roller 25 is moved vertically downward and bears against the inclined surface 24 of sliding member 8. This transfers sliding member 8 in the direction of arrow A back to the position in which the sliding member 8 may be latched. When this occurs, advancing lever 9 slides over a contact and enters into a locked-in position behind the next contact. When lever 17 is returned to the rest position, sliding member 8 latches on lever 17, and the device is again in its rest position. The operational cycle can then be repeated.

It is also possible to continuously operate the device by keeping lever 17 in the second operational position in which switch 26 is always closed. When lever 17 is kept in the second operational position, sliding member 8 cannot be latched in the retracted position and always bears against roller 25. The operator can interrupt the continuous operation at any time by releasing lever 17 which, under the influence of the biasing compression spring 27, returns to the rest position. When lever 17 is transferred from the second operational position to the first operational position rather than to the rest position, the device stops in that part of the operational cycle, at which time a contact is being inserted into the crimping means.

The device is provided with adjustment means comprising an adjusting screw 28 and a counternut 29. By loosening counternut 29, adjusting screw 28 can be set so that advancing lever 9 attached to sliding member 8 can shift the contact strip 7 into a position in which the contact to be crimped is properly situated in the crimping means.

In order to separate the crimped contact from the supporting strip after completion of the crimping operation, a leaf spring 30 bearing against the supporting strip of the contact strip 7 is mounted on guide rail 6. A thrust member 31 is attached to the movable crimping jaw 4. In the end phase of the motion of ram 5, thrust member 31 presses against leaf spring 30 and thereby shears the contact from the supporting strip.

I claim:

1. Apparatus for use in a device for crimping conductors into the contact members of a contact strip, the device being of the type having a motor driven means for reciprocating two crimping jaws relative to each other and feeding means for stepwise advancing the contact strip in increments corresponding to the distance between the contacts in order to feed one contact at a time to the crimping jaws in an operational cycle, said apparatus comprising:

an actuating member movable to a rest position, a first operational position, and a second operational position, said second operational position being reached only after passing through said first operational position;

first means for activating said feeding means to advance said contact strip and position a contact between said crimping jaws when said actuating member is in said first operational position; and second means for activating said motor driven means to effect crimping action of said crimping jaws and for returning said feeding means to its initial position when said actuating member is in said second operational position.

2. The apparatus as claimed in claim 1, wherein said second means includes means for actuating said feeding mens to advance said contact strip when said actuating member is kept in said second operational position after termination of a complete operational cycle.

3. The apparatus as claimed in claim 1, wherein:

said feeding means includes a spring-biased sliding member with which said contact strip can be moved stepwise in increments;

said actuating member includes a lever mechanically coupled to said sliding member so that in the rest position of said actuating member and said lever said sliding member is kept in a latched position;

said sliding member is released from said latched position in order for the sliding member to enter into an unlatched position and advance said strip by an increment corresponding to the contact spacing;

said apparatus including a switch for energizing said motor driven means, said switch actuated by said lever being moved to its second operational position; and said apparatus further includes cam means coupled to one of said crimping jaws to transfer said sliding member into its latched position.

4. The apparatus as claimed in claim 3, including: a locking pin on said sliding member and a stop pawl on said lever, said locking pin and said stop pawl engaging each other in the rest position of said lever and disengaging from each other in said first and said second operational positions of said lever.

5. The apparatus as claimed in claim 3, wherein said cam means includes a beveled front surface on said sliding member and a roller on one of said crimping jaws engageable with said beveled front surface to transfer said sliding member from its unlatched position to its latched position.

6. The apparatus as claimed in claim 2 including a springloaded advancing lever bearing against said sliding member, said advancing lever entering between the contacts of said contact strip for the purpose of advancing said contact strip, said advancing lever adapted to slide over an advancing contact to return to a position of disengagement upon retraction of said sliding member and enter into a locked-in position behind said advancing contact.

7. The apparatus as claimed in claim 3 including a resilient means for biasing said lever to its rest position.

* * * * *